US012668853B2

(12) United States Patent
Mun et al.

(10) Patent No.: US 12,668,853 B2
(45) Date of Patent: Jun. 30, 2026

(54) NON-HEAT TREATED WIRE ROD HAVING EXCELLENT DRAWABILITY AND IMPACT TOUGHNESS AND METHOD FOR MANUFACTURING SAME

(71) Applicant: POSCO, Pohang-si (KR)

(72) Inventors: Dong-Jun Mun, Pohang-si (KR); In-Gyu Park, Pohang-si (KR); Se-Hong Min, Pohang-si (KR)

(73) Assignee: POSCO, Pohang-si (KR)

( * ) Notice: Subject to any disclaimer, the term of this patent is extended or adjusted under 35 U.S.C. 154(b) by 995 days.

(21) Appl. No.: 17/782,947

(22) PCT Filed: Dec. 11, 2020

(86) PCT No.: PCT/KR2020/018188
§ 371 (c)(1),
(2) Date: Jun. 6, 2022

(87) PCT Pub. No.: WO2021/125710
PCT Pub. Date: Jun. 24, 2021

(65) Prior Publication Data

US 2023/0020381 A1 Jan. 19, 2023

(30) Foreign Application Priority Data

Dec. 17, 2019 (KR) ..... 10-2019-0169217

(51) Int. Cl.
*C21D 9/52* (2006.01)
*C21D 6/00* (2006.01)
(Continued)

(52) U.S. Cl.
CPC ..... *C21D 9/525* (2013.01); *C21D 6/002* (2013.01); *C21D 6/005* (2013.01); *C21D 6/008* (2013.01);
(Continued)

(58) Field of Classification Search
CPC ..... C21D 9/525; C21D 2211/005; C21D 2211/009; C22C 38/02; C22C 38/04; C22C 38/06
See application file for complete search history.

(56) References Cited

U.S. PATENT DOCUMENTS

2018/0298464 A1 10/2018 Mun et al.
2018/0305787 A1 10/2018 Mun et al.

FOREIGN PATENT DOCUMENTS

CN 101041880 A 9/2007
CN 106350734 A 1/2017
(Continued)

OTHER PUBLICATIONS

JP2004060049A English language translation (Year: 2004).*
(Continued)

*Primary Examiner* — Sally A Merkling
*Assistant Examiner* — Sean P. O'Keefe
(74) *Attorney, Agent, or Firm* — Morgan Lewis & Bockius LLP

(57) ABSTRACT

Provided are a non-heat treated wire rod having high drawability and impact toughness, and a method for manufacturing the non-heat treated wire rod. The non-heat treated wire rod includes, by wt %, C: 0.02% to 0.30%, Si: 0.05% to 0.8%, Mn: 0.5% to 2.0%, Cr: 1.0% or less, P: 0.03% or less, S: 0.03% or less, sol.Al: 0.01% to 0.07%, N: from greater than 0.01% to 0.02%, Nb: 0.1% or less, V: 0.5% or less, and Ti: 0.1% or less, and a balance of Fe and inevitable impurities, wherein the non-heat treated wire rod has a microstructure including ferrite and pearlite.

6 Claims, 1 Drawing Sheet

(51) Int. Cl.

| | |
|---|---|
| ***C21D 8/06*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/24*** | (2006.01) |
| ***C22C 38/26*** | (2006.01) |
| ***C22C 38/28*** | (2006.01) |
| ***C22C 38/38*** | (2006.01) |

(52) U.S. Cl.

CPC ..... *C21D 8/06* (2013.01); *C22C 38/001* (2013.01); *C22C 38/002* (2013.01); *C22C 38/02* (2013.01); *C22C 38/04* (2013.01); *C22C 38/06* (2013.01); *C22C 38/24* (2013.01); *C22C 38/26* (2013.01); *C22C 38/28* (2013.01); *C22C 38/38* (2013.01); *C21D 2211/005* (2013.01); *C21D 2211/009* (2013.01)

(56) References Cited

FOREIGN PATENT DOCUMENTS

| | | | | |
|---|---|---|---|---|
| CN | 108350549 | A | | 7/2018 |
| JP | H11-131134 | A | | 5/1999 |
| JP | 2003183733 | A | * | 7/2003 |
| JP | 2004-060049 | A | | 2/2004 |
| JP | 2013-007091 | A | | 1/2013 |
| JP | 2014-129582 | A | | 7/2014 |
| JP | 2017-186652 | A | | 10/2017 |
| JP | 2019-502815 | A | | 1/2019 |
| JP | 2019-183267 | A | | 10/2019 |
| KR | 10-2015-0071216 | A | | 6/2015 |
| KR | 10-2016-0068048 | A | | 6/2016 |
| KR | 10-1630978 | B1 | | 6/2016 |
| KR | 10-2017-0056059 | A | | 5/2017 |
| KR | 10-2017-0072996 | A | | 6/2017 |

OTHER PUBLICATIONS

KR1020160068048A English language translation (Year: 2016).*

Extended European Search Report dated Jan. 26, 2023 issued in European Patent Application No. 20902049.4.

Chinese Office Action dated Jan. 31, 2023 issued in Chinese Patent Application No. 202080083378.6 (with English translation).

International Search Report dated Mar. 24, 2021 issued in International Patent Application No. PCT/KR2020/018188 (with English translation).

Japanese Office Action dated Jul. 11, 2023 issued in Japanese Patent Application No. 2022-536895.

* cited by examiner

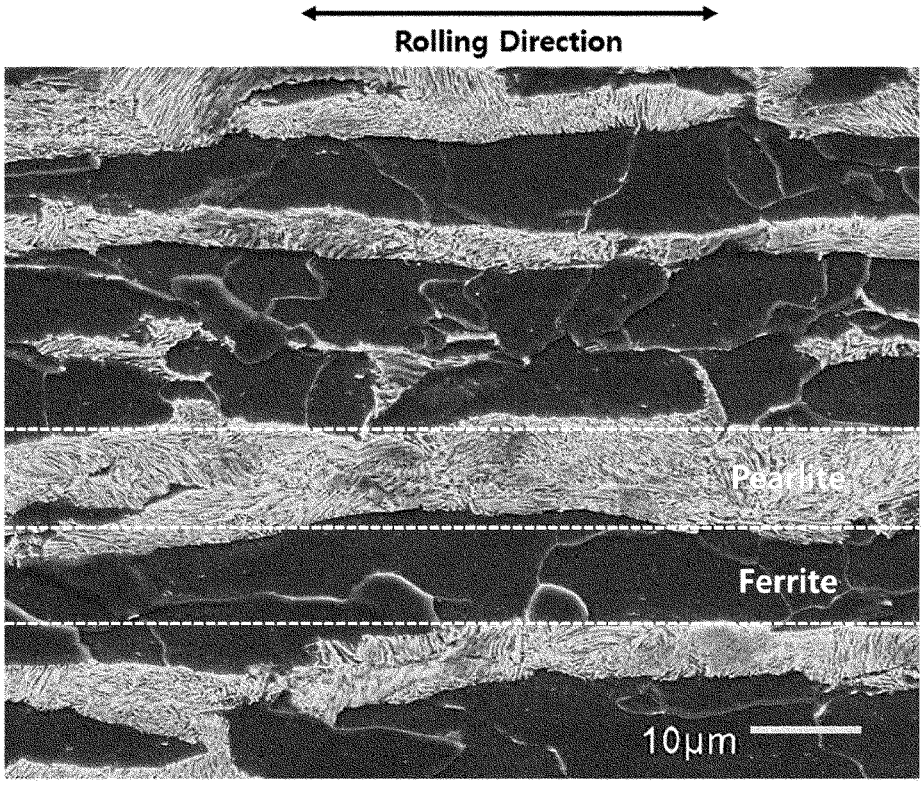
Rolling Direction
Pearlite
Ferrite
10μm

NON-HEAT TREATED WIRE ROD HAVING EXCELLENT DRAWABILITY AND IMPACT TOUGHNESS AND METHOD FOR MANUFACTURING SAME

CROSS-REFERENCE OF RELATED APPLICATIONS

This application is the U.S. National Phase under 35 U.S.C. § 371 of International Patent Application No. PCT/KR2020/018188, filed on Dec. 11, 2020, which in turn claims the benefit of Korean Application No. 10-2019-0169217, filed on Dec. 17, 2019, the entire disclosures of which applications are incorporated by reference herein.

TECHNICAL FIELD

The present disclosure relates to a non-heat treated wire rod, and more particularly, to a non-heat treated wire rod having high strength, drawability, and impact toughness for use as a material for automobiles or machine parts, and a method for manufacturing the non-heat treated wire rod.

BACKGROUND ART

Structural steels used for mechanical structures or automobile parts are mostly heat-treated steels (quenched and tempered steels) which are processed through reheating, quenching, and tempering after hot working for increasing strength and toughness.

Unlike heat-treated steel, non-heat treated steel refers to steel having strength similar to that of heat-treated steel even though a heat treatment has not been performed thereon after hot working. Non-heat treated steel is also called microalloyed steel because small amounts of alloying elements are added thereto.

In the related art, heat-treated wire rod products are finally manufactured through [hot rolling—cold drawing—spheroidizing heat treatment—cold drawing—cold heading—quenching and tempering], whereas non-heat treated wire rod products are finally manufactured through [hot rolling—cold drawing—cold heading].

As described above, non-heat treated wire rods are economically manufactured at low cost because a heat treatment required for manufacturing heat-treated wire rods is omitted. Along therewith, final quenching and tempering are also not performed on non-heat treated wire rods, and thus, non-heat treated wire rods have straightness without defects caused by heat treatment, that is, bending caused by heat treatment. Thus, it has been attempted to apply non-heat treated wire rods to a large number of products.

In particular, pearlite-ferrite-based non-heat treated wire rods are advantageous in that the compositions of pearlite-ferrite-based non-heat treated wire rods are designable with low-cost elements, and uniform microstructures of pearlite-ferrite-based non-heat treated wire rods are stably obtainable through a Stelmor line manufacturing process. However, as the degree of drawing increases, the ductility and toughness of pearlite-ferrite-based non-heat treated wire rods markedly decrease even though the strength of pearlite-ferrite-based non-heat treated wire rods increases.

DISCLOSURE

Technical Problem

An aspect of the present disclosure may provide a non-heat treated wire rod having high strength and impact toughness without additional heat treatment owing to the addition of a large amount of nitrogen, and a method for manufacturing the non-heat treated wire rod. That is, an aspect of the present disclosure is to provide a non-heat treated wire rod by improving the strength, drawability, and toughness of a ferrite-pearlite wire rod having lower toughness than existing heat-treated steel, and a method for manufacturing the non-heat treated wire rod.

Aspects of the present disclosure are not limited to the aspects described above. Those of ordinary skill in the art to which the present disclosure pertains will have no difficulty in understanding other aspects of the present disclosure from the detailed description of the present specification.

Technical Solution

According to an aspect of the present disclosure, a non-heat treated wire rod with high drawability and impact toughness may include, by wt %, C: 0.02% to 0.30%, Si: 0.05% to 0.8%, Mn: 0.5% to 2.0%, Cr: 1.0% or less, P: 0.03% or less, S: 0.03% or less, sol.Al: 0.01% to 0.07%, N: from greater than 0.01% to 0.02%, Nb: 0.1% or less, V: 0.5% or less, and Ti: 0.1% or less, and a balance of Fe and inevitable impurities, wherein the non-heat treated wire rod may have a microstructure including ferrite and pearlite, the ferrite may include a plurality of ferrite bands continuously or discontinuously formed in a direction parallel to a rolling direction of the non-heat treated wire rod with predetermined intervals therebetween, and the pearlite may include a plurality of pearlite bands continuously or discontinuously formed on inner or outer sides of the ferrite bands in the direction parallel to the rolling direction of the non-heat treated wire rod.

According to another aspect of the present disclosure, a non-heat treated wire rod with high drawability and impact toughness may include, by wt %, C: 0.02% to 0.30%, Si: 0.05% to 0.8%, Mn: 0.5% to 2.0%, Cr: 1.0% or less, P: 0.03% or less, S: 0.03% or less, sol.Al: 0.01% to 0.07%, N: from greater than 0.01% to 0.02%, Nb: 0.1% or less, V: 0.5% or less, and Ti: 0.1% or less, and a balance of Fe and inevitable impurities, wherein the non-heat treated wire rod may have a microstructure including ferrite and pearlite, and the ferrite and the pearlite may alternate with each other and may be continuous or discontinuous in a direction parallel to a rolling direction of the non-heat treated wire rod, such that the non-heat treated wire rod may have a banded structure formed by ferrite bands and pearlite bands.

A distance between the ferrite bands adjacent to the ferrite bands may preferably be within a range of 50 μm or less.

The pearlite bands may have an average thickness of 30 μm or less in an L-shaped cross-section parallel to the rolling direction.

The ferrite may have an average grain size of 10 μm in a C cross-section perpendicular to the rolling direction.

When a 30% to 60% drawing process is performed on the non-heat treated wire rod, the non-heat treated wire rod may have an average room-temperature impact toughness of 100 J or more.

According to another aspect of the present disclosure, a method for manufacturing a non-heat treated wire rod having high drawability and impact toughness may include:

preparing a steel material having the composition described above;

reheating the steel material to a reheating temperature Tr satisfying Condition 1 below;

manufacturing a wire rod by finish rolling the reheated steel material at a finish rolling temperature Tf satisfying Condition 2 below; and after the finish rolling, coiling the wire rod and then cooling the wire rod at a cooling rate of 0.1° C./s to 2° C./s.

$T_1 \leq Tr \leq 1200°$ C. [Condition 1]

where $T_1$=757+606 [C]+80 [Nb]/[C]+10231 [Nb]+330 [V]+3000 [N]

$T_2 \leq T_f \leq T_3$ [Condition 2]

where $T_2$=733+52[C]+29.1[Si]−20.7[Mn]+16.9[Cr]−80.6 [Nb]+2000[N], $T_3$=962−300[C]+24.6[Si]−68.1[Mn]−75.6[Cr]−360.1[Nb]−20.7[V]+2000[N], each element refers to a content thereof in wt %, and Tf is in ° C.

According to the present disclosure, the cooled wire rod may have a microstructure including ferrite and pearlite, the ferrite may include a plurality of ferrite bands continuously or discontinuously formed in a direction parallel to a rolling direction of the wire rod with predetermined intervals therebetween, and the pearlite may include a plurality of pearlite bands continuously or discontinuously formed on inner or outer sides of the ferrite bands in the direction parallel to the rolling direction of the wire rod.

A distance between the ferrite bands adjacent to the ferrite bands may preferably be within a range of 50 μm or less.

Advantageous Effects

According to the present disclosure, a large amount of nitrogen is added to the non-heat treated wire rod to utilize nitride-forming elements, and thus although a heat treatment is omitted, the non-heat treated wire rod may be used for products requiring high strength and toughness.

DESCRIPTION OF DRAWINGS

FIG. 1 is a microstructure image illustrating a ferrite-pearlite banded structure according to an embodiment of the present disclosure.

BEST MODE

Hereinafter, the present disclosure will be described.

The inventors have conducted research from various angles in order to provide a wire rod having high strength and impact toughness after a drawing process. As a result, the inventors have found that a wire rod having high strength and impact toughness during a drawing process could be provided without additional heat treatment by adjusting the alloying elements (the addition of a large amount of nitrogen) of the wire rod and forming, in the wire rod, a microstructure in which a ferrite-pearlite (F—P) banded structure is well developed in a rolling direction. Based on this, the inventors provide the present disclosure.

Hereinafter, a non-heat treated wire rod having high cold workability will be described in detail according to an aspect of the present disclosure. The non-heat treated wire rod of the present disclosure includes, by wt %, C: 0.02% to 0.30%, Si: 0.05% to 0.8%, Mn: 0.5% to 2.0%, Cr: 1.0% or less, P: 0.03% or less, S: 0.03% or less, sol.Al: 0.01% to 0.07%, N: from greater than 0.01% to 0.02%, Nb: 0.1% or less, V: 0.5% or less, and Ti: 0.1% or less, and a balance of Fe and inevitable impurities. In addition, the non-heat treated wire rod has a microstructure including ferrite and pearlite, wherein the ferrite includes a plurality of ferrite bands continuously or discontinuously formed in a direction parallel to a rolling direction of the non-heat treated wire rod with predetermined intervals therebetween, and the pearlite includes a plurality of pearlite bands continuously or discontinuously formed on inner or outer sides of the ferrite bands in the direction parallel to the rolling direction of the non-heat treated wire rod.

First, the alloying elements of the non-heat treated wire rod and the contents of the alloying elements will be described in detail according to the present disclosure.

Herein, "%" refers to "wt %" unless otherwise specified.

Carbon (C): 0.02% to 0.3%

Carbon has a function of improving the strength of the wire rod. In the present disclosure, to this end, carbon may preferably be added in an amount of 0.02% or more. However, when the content of carbon is excessive, the deformation resistance of steel markedly increases, resulting in poor cold workability. Therefore, the upper limit of the content of carbon may be preferably 0.3%. More preferably, the content of carbon may be limited to the range of 0.02% to 0.28%.

Silicon (Si): 0.05% to 0.8%

Silicon is a useful element as a deoxidizer. In the present disclosure, to this end, silicon may preferably be added in an amount of 0.05% or more. However, when the content of silicon is excessive, the deformation resistance of steel markedly increases due to solid solution strengthening, causing poor cold workability. Therefore, it may be preferable to limit the content of silicon to 0.8% or less, and more preferably 0.5% or less.

Manganese (Mn): 0.5% to 2.0%

Manganese is an element useful as a deoxidizer and a desulfurization agent. In the present disclosure, to this end, it may be preferable to add manganese in an amount of 0.5% or more, and more preferably in an amount of 0.8% or more. However, when the content of manganese is excessive, the strength of steel excessively increases, and thus the deformation resistance of steel markedly increases, thereby deteriorating cold workability. Therefore, the upper limit of the content of manganese may be preferably 2.0%, and more preferably 1.8%.

Chromium (Cr): 1.0% or Less (Including 0%)

Chromium has a function of promoting ferrite and pearlite transformation during hot rolling. In addition, chromium has a function of reducing the amount of carbon dissolved in steel by precipitating carbides without unnecessarily increasing the strength of the steel, thereby reducing dynamic strain aging caused by solid-solution carbon. However, when the content of chromium is excessive, the strength of steel excessively increases, and thus the deformation resistance of the steel markedly increases, thereby deteriorating cold workability. Therefore, the upper limit of the content of chromium may be preferably 1.0%, and more preferably 0.8%.

Phosphorus (P): 0.03% or Less

Phosphorus is an inevitable impurity element, which is a main cause of decreasing the toughness and delayed fracture resistance of steel because phosphorous segregates along grain boundaries. Thus, it is preferable that the content of phosphorous be as low as possible. Theoretically, it is preferable to control the content of phosphorus to be 0%, but phosphorous is inevitably included during manufacturing processes. Therefore, it is important to control the upper limit of the content of phosphorous, and in the present disclosure, the upper limit of the content of phosphorus is controlled to be 0.03%.

Sulfur (S): 0.03% or Less

Sulfur is an inevitable impurity element, which a main cause of markedly decreasing the ductility of steel through segregation along grain boundaries and deteriorating the delayed fracture resistance and stress relaxation characteristics of steel through the formation of sulfides. Thus, it is preferable that the content of sulfur be as low as possible. Theoretically, it is preferable to control the content of sulfur to be 0%, but sulfur is inevitably included during manufacturing processes. Therefore, it is important to control the upper limit of the content of sulfur, and in the present disclosure, the upper limit of the content of sulfur is controlled to be 0.03%.

Aluminum (sol.Al): 0.01% to 0.07%

Sol.Al is an element useful as a deoxidizer and is added in an amount of 0.01% or more. The content of sol.Al may be preferably 0.015% or more, and more preferably 0.02% or more. When the content of Al exceeds 0.07%, the effect of refining austenite grains by the formation of AlN increases, and thus cold forgeability deteriorates. Therefore, in the present disclosure, the upper limit of the content of Al is set to be 0.07%.

Nitrogen (N): From Greater than 0.01% to 0.02%

The content of nitrogen is a key factor for realizing the effects of the present disclosure. When the content of nitrogen is 0.01% or less, it is difficult to secure the formation of nitrides, and thus the amounts of precipitates such as Nb, V, and Ti are reduced. In this case, intended properties may not be obtained. In addition, when the content of nitrogen exceeds 0.02%, the amount of dissolved nitrogen which does not combine with precipitates may increase, and thus the toughness and ductility of the wire rod may deteriorate. Therefore, in the present disclosure, it is preferable that the content of nitrogen range from greater than 0.01% to 0.02%.

According to the present disclosure, the non-heat treated wire rod may further include at least one selected from the group consisting of niobium (Nb), vanadium (V), and titanium (Ti) in addition to the elements described above.

Niobium (Nb): 0.1% or Less

Niobium (Nb) is an element that forms carbide and carbonitride and thus limits the grain boundary movement of austenite and ferrite. However, since the carbonitride may act as a fracture origin and thus reduce impact toughness, it is preferable to add Nb in an amount not greater than the solubility limit thereof. In the present disclosure, when the content of Nb exceeds 0.1%, there is a problem of forming coarse precipitates. Therefore, it may be preferable to limit the content of Nb to 0.1% or less.

Vanadium (V): 0.5% or Less

Vanadium (V), like niobium (Nb), forms carbide and carbonitride and thus limits the grain boundary movement of austenite and ferrite. However, since the carbonitride may act as a fracture origin and thus reduce impact toughness, it is preferable to add V in an amount not greater than the solubility limit thereof. In the present disclosure, when the content of V exceeds 0.5%, there is a problem of forming coarse precipitates. Therefore, it may be preferable to limit the content to 0.5% or less.

Titanium (Ti): 0.1% or Less

Titanium (Ti) also has the effect of limiting the grain size of austenite by combining with carbon and nitrogen to form carbonitride. However, when the content of Ti exceeds 0.1%, there is a problem of forming coarse precipitates which are likely to act as a major crack forming source resulting in inclusion fracture. Therefore, it is preferable to limit the content of Ti to 0.1% or less.

The balance other than the alloying elements described above is Fe. In addition, the wire rod for drawing of the present disclosure may include other impurities which may be included thereto during normal industrial steel production processes. The types and contents of these impurities are known to those of ordinary skill in the art to which the present disclosure pertains and are thus not particularly specified in the present disclosure.

In addition, according to an embodiment of the present disclosure, the non-heat treated wire rod has a microstructure including ferrite and pearlite.

In addition, the ferrite includes a plurality of ferrite bands continuously or discontinuously formed in a direction parallel to the rolling direction of the wire rod with predetermined intervals therebetween, and the pearlite includes a plurality of pearlite bands continuously or discontinuously formed on inner or outer sides of the ferrite bands in the direction parallel to the rolling direction of the wire rod. In other words, the ferrite and the pearlite have a banded structure in which the ferrite and pearlite bands alternate with each other and are continuously or discontinuously in the direction parallel to the rolling direction of the wire rod.

FIG. 1 is a microstructure image illustrating a ferrite-pearlite banded structure according to an embodiment of the present disclosure. As shown in FIG. 1, in the present disclosure, ferrite includes a plurality of ferrite bands continuously or discontinuously formed in a direction parallel to a rolling direction with predetermined intervals therebetween, and pearlite includes a plurality of pearlite bands continuously or discontinuously formed on inner or outer sides of the ferrite bands in the direction parallel to the rolling direction of the wire rod. That is, in the present disclosure, ferrite and pearlite form bands alternating each other and continuous or discontinuous in a direction parallel to the rolling direction of the wire rod, and thus it may be said that a ferrite-pearlite banded structure is formed in a direction parallel to the rolling direction. Owing to the ferrite-pearlite banded structure, an initial microstructure before drawing has an arrangement direction suitable for drawing, thereby securing high drawability. In addition, when the ferrite-pearlite banded structure is stretched in the rolling direction through a drawing process, an impact may not easily propagate in the thickness direction of the wire rod, but may propagate along the interface between ferrite and pearlite, thereby improving impact toughness.

In the present disclosure, the area fraction of ferrite may preferably be maintained within the range of 30% to 90%. When the microstructure of the wire rod is formed as described above, high drawability and impact toughness may be secured in addition to securing strength.

In addition, the distance between the ferrite bands adjacent to the ferrite bands may preferably be within the range of 50 μm or less.

In the pearlite structure of the present disclosure, the average thickness of the pearlite bands in an L-shaped cross-section parallel to the rolling direction may be 30 μm or less. In addition, the average grain size of ferrite in a C cross-section perpendicular to the rolling direction may be 10 μm or less.

The thickness of the pearlite bands refers to the thickness of the pearlite bands in an L-shaped cross-section parallel to the rolling direction, and when the average thickness of the pearlite bands exceeds 30 μm, it may be difficult to secure intended impact toughness.

The grain size of ferrite refers to the grain size of ferrite in a C cross-section perpendicular to the rolling direction, and preferably, the average grain size of ferrite may be 10 μm or less. If the average grain size of ferrite exceeds 10 μm, it may be difficult to secure intended impact toughness. Here, the term "average grain size" refers to an average equivalent circular diameter of grains detected by observing a cross-section of a steel sheet, and the average grain size of pearlite formed together with ferrite is affected by the average grain size of ferrite and is thus not particularly limited.

The pearlite structure of the present disclosure may have an average lamellar spacing of 0.03 μm to 0.3 μm. The finer the lamellar spacing of the pearlite structure, the higher the strength of the wire rod. However, if the lamellar spacing of the pearlite structure is less than 0.03 μm, cold workability may deteriorate, and if the lamellar spacing of the pearlite structure is greater than 0.3 μm, it may be difficult to secure intended strength.

When the wire rod of the present disclosure having the composition and microstructure described above is subjected to 30% to 60% drawing, an average impact toughness value of 100 J or more may be obtained at room temperature.

Next, a method for manufacturing a non-heat treated wire rod will be described according to an aspect of the present disclosure.

According to the present disclosure, the method for producing a non-heat treated wire rod having high strength and impact toughness includes: preparing a steel material having the composition described above; reheating the steel material to a reheating temperature Tr satisfying Condition 1 below; manufacturing a wire rod by finish rolling the reheated steel material at a finish rolling temperature Tf satisfying Condition 2 below; and coiling the wire rod after the finish rolling and then cooling the wire rod at a cooling rate of 0.1° C./s to 2° C./s.

According to the present disclosure, first, a steel material having the composition described above is prepared and reheated. According to the present disclosure, in this case, it is required to reheat the steel material to a reheating temperature Tr satisfying Condition 1 below:

$$T_1 \leq Tr \leq 1200° C. \quad \text{[Condition 1]}$$

where $T_1=757+606[C]+80[Nb]/[C]+1023\sqrt{[Nb]}+330[V]+3000[N]$

This process is for re-dissolving carbonitrides composed of Nb, V, or the combination thereof in the steel material. When carbonitrides composed of Nb, V or the combination thereof do not dissolve but remain during the reheating in a heating furnace, continuous grain coarsening occurs while the steel material is maintained at high temperature. In this case, it may be difficult to refine ferrite grains in a subsequent wire rod rolling process, and a mixed-grain structure may be formed in a cooling process.

If the reheating temperature Tr of the steel material is less than $T_1$ defined in Condition 1 above, coarse carbonitrides composed of Nb, V or the combination thereof may not completely re-dissolve, and if the reheating temperature of the steel material exceeds 1200° C., austenite may overgrow to result in a decrease in ductility.

Next, in the present disclosure, a wire rod is manufactured by finishing rolling the reheated steel material at a finish rolling temperature Tf satisfying Condition 2 below:

$$T_2 \leq T_f \leq T_3 \quad \text{[Condition 2]}$$

where $T_2=733+52[C]+29.1[Si]-20.7[Mn]+16.9[Cr]-80.6[Nb]+2000[N]$, $T_3=962-300[C]+24.6[Si]-68.1[Mn]-75.6[Cr]-360.1[Nb]-20.7[V]+2000[N]$, each element refers to the content thereof in wt %, and the unit of Tf is ° C.

The finish rolling temperature Tf affects the alloy microstructure of the wire rod and is thus a very important process condition for forming a ferrite-pearlite banded structure. That is, when the finish rolling is performed under Condition 2 above, a ferrite-pearlite banded structure may be well formed.

If the finish rolling temperature Tf is less than $T_2$ of Condition 2 above, deformation resistance may increase due to the refinement of ferrite grain boundaries, and thus cold forgeability may deteriorate. If the finish rolling temperature Tf exceeds $T_3$, the ferrite-pearlite banded structure may not be well formed.

Thereafter, according to the present disclosure, the wire rod formed through the finish rolling is coiled and then cooled at a cooling rate of 0.1° C./s to 2° C./s, thereby manufacturing a wire rod having a final microstructure.

That is, in the present disclosure, the process of coiling and cooling the wire rod after the finish rolling corresponds to a process of controlling the lamellar spacing of pearlite in the ferrite-pearlite banded structure formed under finish rolling conditions.

In a ferrite-pearlite microstructure, pearlite improves strength but may act as a major factor in toughness deterioration. In this case, however, fine pearlite lamellar spacing is relatively advantageous in terms of toughness. Therefore, according to the present disclosure, it is required to appropriately control the cooling rate in order to obtain fine pearlite lamellar spacing in the cooling process.

In the present disclosure, it is preferable to adjust the average rate of cooling to be within the range of 0.1° C./s to 2° C./s during the cooling process. If the cooling rate is excessive low, lamella spacing may increase, and thus ductility may be insufficient. If the cooling rate is excessively high, a low-temperature microstructure may be formed, and thus toughness may markedly decrease.

More preferably, the average cooling rate may be adjusted to be within the range of 0.3° C./s to 1° C./s. When the cooling rate is controlled within the range, a non-heat treated wire rod having high ductility and toughness may be obtained while imparting sufficient strength to the non-heat treated wire rod.

As described above, in the present disclosure, the composition and manufacturing processes of a steel material are controlled. That is, according to the present disclosure, a wire rod having the above-described ferrite-pearlite banded structure may be effectively manufactured by using a steel material having the above-described composition through optimized manufacturing processes (reheating—rolling—cooling).

MODE FOR INVENTION

Hereinafter, the present disclosure will be described in more detail through examples. It should be noted that the following examples are only for the understanding of the present disclosure, and are not intended to specify the scope of the present disclosure.

EXAMPLES

Steel materials having the compositions shown in Table 1 below were heated for 3 hours at heating temperatures shown in Table 2 below, and were then hot rolled to fabricate wire rods having a diameter of 20 mm. At that time, finish rolling temperatures were set as shown in Table 2 below, and then the wire rods were coiled and cooled at cooling rates shown in Table 2 below.

Thereafter, the types and fractions of microstructures, the thicknesses of pearlite bands, and pearlite lamellar spacings were analyzed and measured, and results thereof are shown in Table 2 below.

In addition, after performing a 30% to 60% drawing process on the wire rods having the microstructures, the tensile strength and impact toughness of each of the wire rods were measured at room temperature, and results thereof are shown in Table 3 below. Here, the room-temperature tensile strength was measured by sampling a center portion of a non-heat treated steel specimen at 25° C., and the room-temperature impact toughness was evaluated using a Charpy impact energy value obtained by performing a Charpy impact test at 25° C. on a specimen having a U-notch (U-notch standard sample, 10×10×55 mm).

TABLE 1

| Steel | Composition (wt %) | | | | | | | | | | |
|---|---|---|---|---|---|---|---|---|---|---|---|
| No. | C | Si | Mn | P | S | Cr | Al | Nb | V | Ti | N |
| 1 | 0.08 | 0.17 | 1.62 | 0.010 | 0.0050 | — | 0.024 | 0.030 | — | — | 0.0110 |
| 2 | 0.14 | 0.22 | 1.54 | 0.011 | 0.0070 | — | 0.028 | — | 0.110 | — | 0.0120 |
| 3 | 0.19 | 0.25 | 1.47 | 0.012 | 0.0150 | — | 0.032 | — | — | 0.015 | 0.0105 |
| 4 | 0.26 | 0.32 | 1.35 | 0.009 | 0.0130 | 0.15 | 0.035 | 0.015 | 0.080 | — | 0.0130 |
| 5 | 0.07 | 0.20 | 1.33 | 0.008 | 0.0056 | — | 0.021 | 0.025 | — | — | 0.0042 |
| 6 | 0.15 | 0.17 | 1.26 | 0.011 | 0.0078 | 0.11 | 0.020 | — | 0.12 | — | 0.0038 |
| 7 | 0.21 | 0.23 | 1.20 | 0.010 | 0.0043 | 0.20 | 0.027 | — | — | 0.011 | 0.0067 |
| 8 | 0.27 | 0.26 | 1.10 | 0.009 | 0.0120 | 0.13 | 0.03 | 0.010 | 0.055 | — | 0.0240 |

TABLE 2

| Steel No. | MS | $T_1$ (° C.) | Tr (° C.) | $T_2$ (° C.) | $T_3$ (° C.) | Tf (° C.) | Cooling rate (° C./s) | F fraction (%) | F average grain size (μm) in C cross-section | P average band thickness (μm) in L-shaped cross-section | P lamellar spacing (μm) | Remarks |
|---|---|---|---|---|---|---|---|---|---|---|---|---|
| 1 | F + P | 1046 | 1085 | 728 | 843 | 803 | 1.1 | 78 | 5.8 | 13 | 0.24 | Inventive Example 1 |
| | F + P | 1046 | 1018 | 728 | 843 | 872 | 0.8 | 80 | 12.4 | 17 | 0.32 | Comparative Example 1 |
| 2 | F + P | 914 | 1043 | 738 | 842 | 798 | 0.9 | 70 | 6.7 | 18 | 0.21 | Inventive Example 2 |
| | F + P | 914 | 1064 | 738 | 842 | 887 | 1.0 | 69 | 13.9 | 26 | 0.25 | Comparative Example 2 |
| 3 | F + P | 904 | 1060 | 740 | 832 | 785 | 0.7 | 62 | 6 | 24 | 0.23 | Inventive Example 3 |
| | F + P | 904 | 1122 | 740 | 832 | 897 | 2.1 | 60 | 15.7 | 31 | 0.30 | Comparative Example 3 |
| 4 | F + P | 1110 | 1134 | 755 | 807 | 776 | 0.5 | 53 | 7.4 | 27 | 0.27 | Inventive Example 4 |
| | F + P | 1110 | 1022 | 755 | 807 | 868 | 1.5 | 50 | 13.5 | 33 | 0.26 | Comparative Example 4 |
| 5 | F + P | 1002 | 1052 | 721 | 854 | 801 | 0.6 | 80 | 9.8 | 21 | 0.31 | Comparative Example 5 |
| 6 | F + P | 89 | 1077 | 729 | 832 | 853 | 0.8 | 72 | 13.3 | 25 | 0.28 | Comparative Example 6 |
| 7 | F + P | 904 | 1112 | 742 | 821 | 845 | 0.7 | 56 | 14.8 | 32 | 0.26 | Comparative Example 7 |
| 8 | F + P | 1116 | 1064 | 781 | 845 | 837 | 2.2 | 47 | 11.2 | 35 | 0.33 | Comparative Example 8 |

In Table 1, F refers to ferrite, and P refers to pearlite. In addition, $T_1$ is a temperature defined in Condition 1, and $T_2$ and $T_3$ are temperatures defined in Condition 2. In addition, MS refers to microstructure, Tr refers to a reheating temperature, and Tf refers to a finish rolling temperature.

TABLE 3

| | 0% drawing | | 35% drawing | | 45% drawing | | 55% drawing | | |
|---|---|---|---|---|---|---|---|---|---|
| Steel No. | TS (Mpa) | IT (J) | TS (Mpa) | IT (J) | TS (Mpa) | IT (J) | TS (Mpa) | IT (J) | Remarks |
| 1 | 557 | 332 | 772 | 234 | 831 | 214 | 887 | 193 | Inventive Example 1 |
| | 564 | 328 | 784 | 187 | 852 | 138 | 899 | 96 | Comparative Example 1 |
| 2 | 668 | 248 | 854 | 188 | 906 | 167 | 962 | 172 | Inventive Example 2 |
| | 675 | 235 | 867 | 162 | 917 | 116 | 970 | 84 | Comparative Example 2 |
| 3 | 586 | 275 | 783 | 215 | 852 | 206 | 911 | 187 | Inventive Example 3 |
| | 592 | 267 | 797 | 174 | 873 | 129 | 934 | 77 | Comparative Example 3 |
| 4 | 654 | 233 | 848 | 186 | 899 | 172 | 945 | 163 | Inventive Example 4 |
| | 651 | 224 | 856 | 141 | 908 | 102 | 962 | 65 | Comparative Example 4 |
| 5 | 522 | 272 | 720 | 202 | 772 | 137 | 835 | 98 | Comparative Example 5 |
| 6 | 606 | 221 | 796 | 163 | 847 | 112 | 884 | 89 | Comparative Example 6 |
| 7 | 534 | 243 | 724 | 171 | 783 | 134 | 832 | 61 | Comparative Example 7 |
| 8 | 689 | 157 | 892 | 94 | 945 | 67 | 988 | 42 | Comparative Example 8 |

* In Table 3, TS refers to tensile strength, and IT refers to impact toughness.

As shown in Tables 1-3 above, Inventive Examples 1-4, which satisfy the composition (high N content) and manufacturing conditions proposed in the present disclosure, have high strength and impact toughness after drawing owing to the ferrite-pearlite (F—P) banded structure developed in the rolling direction.

However, Comparative Examples 1-4 have compositions within the scope of the present disclosure but do not satisfy the manufacturing process conditions of the present disclosure. Specifically, Comparative Examples 1 and 4 do not satisfy the reheating temperature and the finish rolling temperature, Comparative Example 2 does not satisfy the finish rolling temperature, and Comparative Example 3 does not satisfy the finish rolling temperature and the cooling rate. Thus, the impact toughness of the comparative examples is lower than that of the inventive examples.

In addition, Comparative Examples 5-8, which do not satisfy the composition and manufacturing conditions proposed in the present disclosure, do not sufficiently have the F—P banded structure in the rolling direction as proposed in the present disclosure and thus have impact toughness lower than that of the inventive examples.

The present disclosure is not limited to the embodiments and examples described above, and various different forms may be manufactured according to the present disclosure. Those of ordinary skill in the art to which the present disclosure pertains will understand that other specific forms may be provided without departing from the technical spirit or features of the present disclosure. Therefore, the embodiments and examples described above should be considered in a descriptive sense only and not for purposes of limitation.

The invention claimed is:

1. A non-heat treated wire rod, the non-heat treated wire rod comprising, by wt %, C: 0.02% to 0.30%, Si: 0.05% to 0.8%, Mn: 0.5% to 2.0%, Cr: 1.0% or less, P: 0.03% or less, S: 0.03% or less, sol.Al: 0.01% to 0.07%, N: from greater than 0.01% to 0.02%, Nb: 0.1% or less, V: 0.5% or less, and Ti: 0.1% or less, and a balance of Fe and inevitable impurities, wherein the non-heat treated wire rod has a microstructure comprising ferrite and pearlite, and the ferrite and the pearlite alternate with each other and are continuous or discontinuous in a direction parallel to a rolling direction of the non-heat treated wire rod such that the non-heat treated wire rod has a banded structure formed by ferrite bands and pearlite bands, wherein the ferrite has an average grain size of 10 m in a C cross-section perpendicular to the rolling direction, and wherein when a 30% to 60% drawing process is performed on the non-heat treated wire rod, the non-heat treated wire rod has an average room-temperature impact toughness of 100 J or more.

2. A non-heat treated wire rod, the non-heat treated wire rod comprising, by wt %, C: 0.02% to 0.30%, Si: 0.05% to 0.8%, Mn: 0.5% to 2.0%, Cr: 1.0% or less, P: 0.03% or less, S: 0.03% or less, sol.Al: 0.01% to 0.07%, N: from greater than 0.01% to 0.02%, Nb: 0.1% or less, V: 0.5% or less, and Ti: 0.1% or less, and a balance of Fe and inevitable impurities, wherein the non-heat treated wire rod has a microstructure comprising ferrite and pearlite, the ferrite comprises a plurality of ferrite bands continuously or discontinuously formed in a direction parallel to a rolling direction of the non-heat treated wire rod with predetermined intervals therebetween, and the pearlite comprises a plurality of pearlite bands continuously or discontinuously formed on inner or outer sides of the ferrite bands in the direction parallel to the rolling direction of the non-heat treated wire rod, wherein the ferrite has an average grain size of 10 m in a C cross-section perpendicular to the rolling direction, and wherein when a 30% to 60% drawing process is performed on the non-heat treated wire rod, the non-heat treated wire rod has an average room-temperature impact toughness of 100 J or more.

3. The non-heat treated wire rod of claim 2, wherein the ferrite bands and the pearlite bands are alternately formed in the direction parallel to the rolling direction of the non-heat treated wire rod.

4. The non-heat treated wire rod of claim 2, wherein a distance between the ferrite bands adjacent to the ferrite bands is within a range of 50 m or less.

5. The non-heat treated wire rod of claim 2, wherein the ferrite has an area fraction of 30% to 90%.

6. The non-heat treated wire rod of claim 2, wherein the pearlite bands have an average thickness of 30 m or less in an L-shaped cross-section parallel to the rolling direction.

* * * * *